United States Patent [19]

Hashimoto

[11] Patent Number: 4,464,956

[45] Date of Patent: Aug. 14, 1984

[54] CORK-EXTRACTING DEVICE

[75] Inventor: Kenji Hashimoto, Tokyo, Japan

[73] Assignee: Kabushiki Kaisha Kenshin, Todoroki, Japan

[21] Appl. No.: 281,938

[22] Filed: Jul. 10, 1981

[30] Foreign Application Priority Data

Jan. 28, 1981 [JP] Japan ..... 56-11116

[51] Int. Cl.[3] ..... B67B 7/08

[52] U.S. Cl. ..... 81/3.2; 81/3.48; 141/19; 222/5

[58] Field of Search ..... 81/3.2, 3.1 R, 3.34, 81/3.48; 141/19, 329; 128/218 NV, 218 R, 218 DA, 218 PA; 261/DIG. 38; 137/251, 68 R, 318, 797; 222/5; 169/76; 251/364-365; 604/140, 148, 411, 414

[56] References Cited

U.S. PATENT DOCUMENTS

| | | | |
|---|---|---|---|
| 2,328,805 | 9/1943 | Holthouse | 251/364 |
| 2,705,578 | 4/1955 | Burns | 222/5 X |
| 3,428,075 | 2/1969 | Wagner | 137/318 |
| 3,471,123 | 10/1969 | Carlson et al. | 251/364 X |
| 4,317,390 | 3/1982 | Nakayama | 81/3.2 |

FOREIGN PATENT DOCUMENTS

| | | | |
|---|---|---|---|
| 684309 | 4/1964 | Canada | 222/5 |

*Primary Examiner*—Frederick R. Schmidt
*Assistant Examiner*—Debra S. Meislin
*Attorney, Agent, or Firm*—Browdy and Neimark

[57] ABSTRACT

An improved cork-extracting device having a gas bomb filled with carbonic acid gas, inert gas or the like. The gas in the bomb is fed into the air-space present below the cork of the container, such as a bottle containing beverages such as wine, through a insertion needle whereby the pressure in the container raises to remove the cork automatically. The cork-extracting device is characterized in that a valve seat of a needle valve, which opens and closes the gas supply port, is made of a resilient valve seat plate, the lower surface of the resilient valve seat plate being used as a packing for supporting the cap of the gas bomb, accommodated in a cylindrical container, and the needle valve being able to protrude the resilient valve seat plate to open the cap of the gas bomb.

6 Claims, 4 Drawing Figures

CORK-EXTRACTING DEVICE

TECHNICAL FIELD OF THE INVENTION

The present invention relates to a cork-extracting device for uncorking containers such bottles or the like which contain wine or other beverages.

BACKGROUND ART

Known cork-extracting devices are such that consist of a screw rod with a handle, which screw rod is to be screwed into the cork thereby to be pulled out. Such screw rod, however, often screws into the cork aslant that sometimes causes damage of the cork. In order to avoid such inconvenience, skill is required to operate it properly. In the worst case, the cork comes to pieces which fall into the bottle and as the result, to uncork the bottle become difficult.

There has been proposed a cork-extracting device by which carbonic acid gas from a gas bomb is fed into a bottle through a probe inserted in the cork to raise the pressure within the bottle thereby to uncork the bottle. However, no particular contrivance has been made on this kind device with due regard to dealing with the gas itself. In this kind of device, an expensive gas bomb filled with gas is for one-time use and can not be repeatedly used, which is really disadvantageous in view of economy (Japanese Patent Publication No. 17718/67).

DISCLOSURE OF THE INVENTION

An object of the present invention is to provide an improved cork-extracting device which is free of such defects as aforementioned of known cork-extracting devices by employing a resilient valve seat as the needle valve having an air passage which opens and closes the gas supply hole so that not only a sufficient seal by the needle valve to prevent the leakage of gas is assured, but also repeated use of the gas bomb is made possible.

Another object of the present invention is to provide an improved cork-extracting device of which a resilient valve seat plate which is formed as the valve seat of needle valve for opening and closing the gas supply hole enables the needle valve to be provided protruding beyond the resilient valve seat plate and therefore may be used as a cap of the gas bomb.

A further object of the present invention is to provide a cork-extracting device of which a resilient valve seat plate which is formed as the valve seat of needle valve for opening and closing the gas supply hole enables the lower surface of the resilient valve seat plate to be directly used as a packing for supporting the cap of the gas bomb which is accommodated in a cylindrical container.

In a summary, the gist of the present invention lies in an improved cork-extracting device which comprises: a cylindrical container accommodating a gas bomb which is to be filled with carbonic acid gas, inert gas or the like; an insertion needle having a longitudinal air passage which communicates with the cylindrical container, the insertion needle being located on the outside and at the bottom of the cylindrical container; a cover with a packing for sealing, which is detachably attached to an opening portion of the cylindrical container, the cover having a needle valve, which ascends and descends therein, and further having a resilient valve seat plate at a position opposed to the needle valve, the resilient valve seat plate having a valve seat which has a gas supply hole at the center thereof, and the lower surface of the resilient valve seat plate being utilized as a packing to support the cap of the gas bomb accommodated in the cylindrical container; a gas-flow path formed between the upper surface of the resilient valve seat plate and the cylindrical container; an operation handle fitted to one side of the cover, being supported by a rotary shaft and urged by a spring; and an opening/closing cam provided for the operation rod to maintain the needle valve in a closed state all the time.

BRIEF DESCRIPTION OF THE DRAWING

In order that the nature of the present invention may be readily ascertained, an embodiment of cork-extracting device in accordance therewith is hereinafter particularly described with reference to the accompanying drawing, wherein.

DESCRIPTION OF EMBODIMENTS

Figure 1:
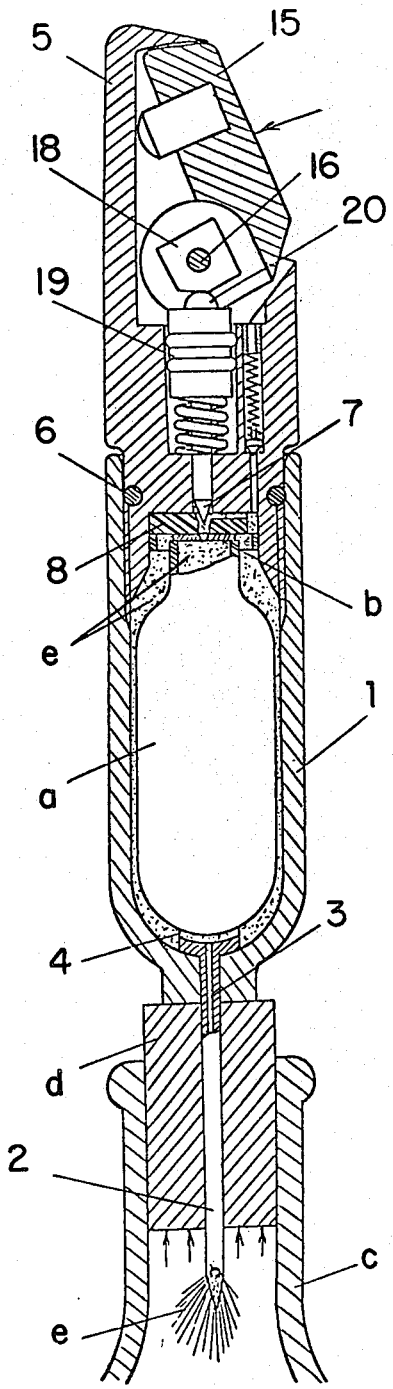
FIG. 1 is a longitudinal cross-sectional view of the device when it is used.

In the drawings, reference numeral 1 denotes a cylindrical container to accommodate a gas bomb (a) which contains carbonic acid gas, inert gas or the like. There is formed a suitable gap between the gas bomb (a) and the inner wall of the cylindrical container 1 to form a gas-flow path. Reference numeral 2 denotes a hollow needle having a longitudinal air passage 3 which is attached to the outer portion at the bottom of the cylindrical container 1. Reference numeral 4 denotes a guide groove, which is provided with the place where the needle 2 is mounted, to communicate the air passage 3 with the inside of the cylindrical container 1. Reference numeral 5 denotes a cover to seal the opening of the cylindrical container 1, which is detachably screwed into the cylindrical container 1 by way of conventional means. Reference numeral 6 denotes a packing for sealing which is placed between the cylindrical container 1 and the cover 5. Reference numeral 7 denotes a needle valve positioned at the internal center of the cover 5 which may ascend and descend. And the needle valve 7 is positioned so as to face a cap (b) of the gas bomb (a) accommodated in the cylindrical container 1. Reference numeral 8 denotes a resilient valve seat plate made of a resilient member of the type of a synthetic resin rubber such as urethane rubber. The resilient valve seat plate 8 has a valve seat 10 being contiguous with a gas supply hole 9, with which valve seat plate 8 the needle valve 7 comes into contact. Further, the lower surface of the resilient valve seat plate comes into contact with the cap (b) of the gas bomb (a) accommodated in the cylindrical container 1. Reference numeral 11 (see FIG. 3) denotes a recessed portion to permit deflection of the resilient valve seat plate 8, which may be, if necessary, formed in the periphery of the gas supply hole 9 on the lower surface of the resilient valve seat plate 8. Reference numeral 12 denotes a gas-flow groove formed on the upper surface of the resilient valve seat plate 8, which communicates the valve seat 10 at the center of the resilient valve seat plate 8 with a gas-flow notch 13 formed in a peripheral portion thereof to form a gas-flow path between the upper surface of the resilient valve seat plate 8 and the cylindrical container 1. Reference numeral 14 denotes a metal holder to support the peripheral portion of the resilient valve seat plate 8 in stable state. This metal holder 14 serves to support the neck part of the gas bomb (a). Reference numeral 15 denotes an operation handle provided with a side of the cover 5. The operation handle 15 is rotatably held at its base portion by a rotary shaft 16, and is always maintained to be situated in a normal position by a spring 17. Reference numeral 18 denotes an opening/closing cam to ascend and descend the needle valve 7 by contact with the head portion of a valve rod 19 which supports the needle valve 7. The cam 18 can be in any shape as long as it may be rotated when the operation rod 15 is depressed whereby the needle valve 7 is first forewardly descended and backwardly ascended to a position higher than the initial position to form a small clearance between the valve seat 10 and the needle valve 7. Reference numeral 20 denotes a globe which is rotatably fitted to the head portion of the valve rod 19 and provides smooth sliding contact with the cam 18. Reference numeral 21 (see FIG. 2) denotes a spring to urge the valve rod 19 upward. Reference numeral 22 denotes a relief valve provided in an exhaust hole communicating the inside with the outside of the cover 5 to reduce the pressure within the cylindrical container 1 when gas pressure therein becomes abnormally high.

Figure 2:
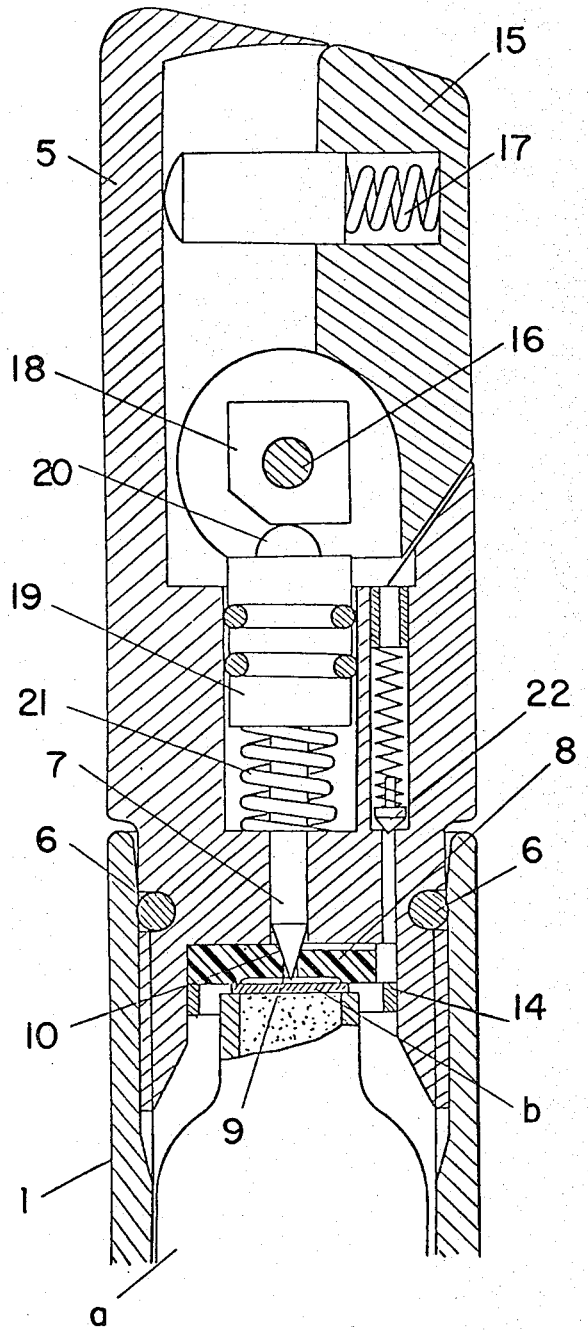
FIG. 2 is a longitudinal cross-sectional view of the major portion of the device where the needle valve is closed.

To use the improved cork-extracting device of the present invention structured as mentioned above, the gas bomb (a) is first accommodated in the cylindrical container 1, and the cover 5 is fitted to the cylindrical container 1. In this case, as shown in FIG. 2, the cap (b) of the gas bomb (a) is brought into contact with the lower surface of the resilient valve seat plate 8.

Figure 3:
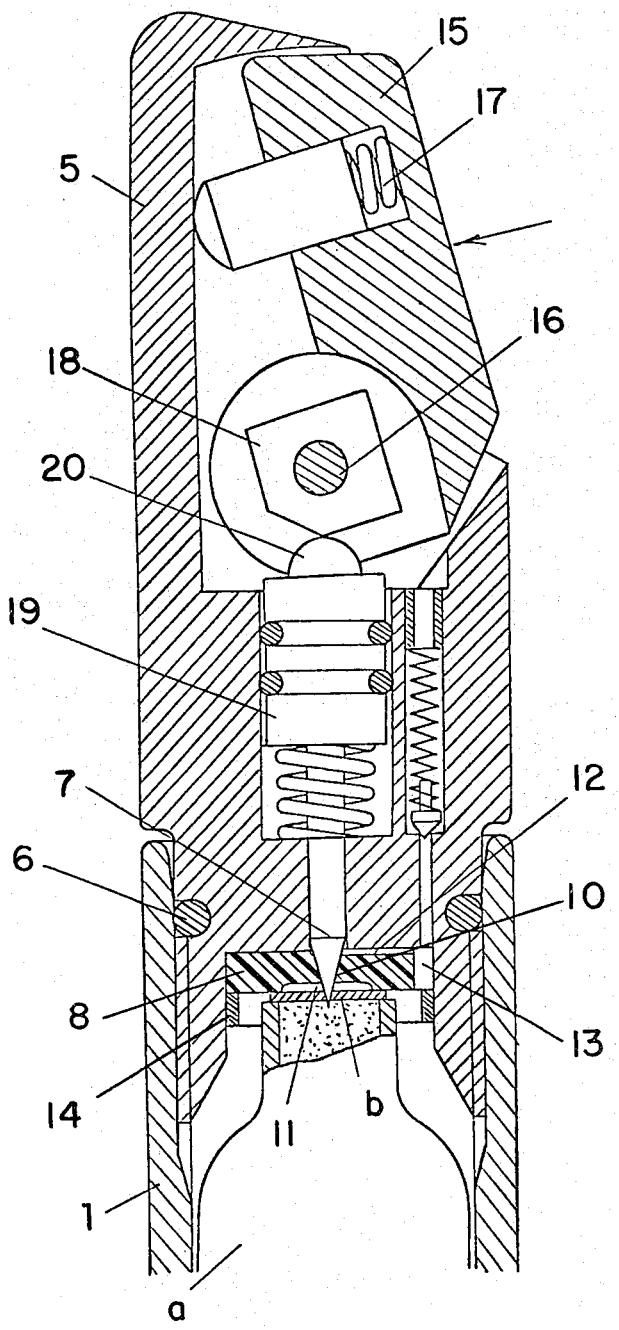
FIG. 3 is a longitudinal cross-sectional view of the major portion of the device where the cap of a gas bomb is opened by means of the needle valve.
Figure 4:
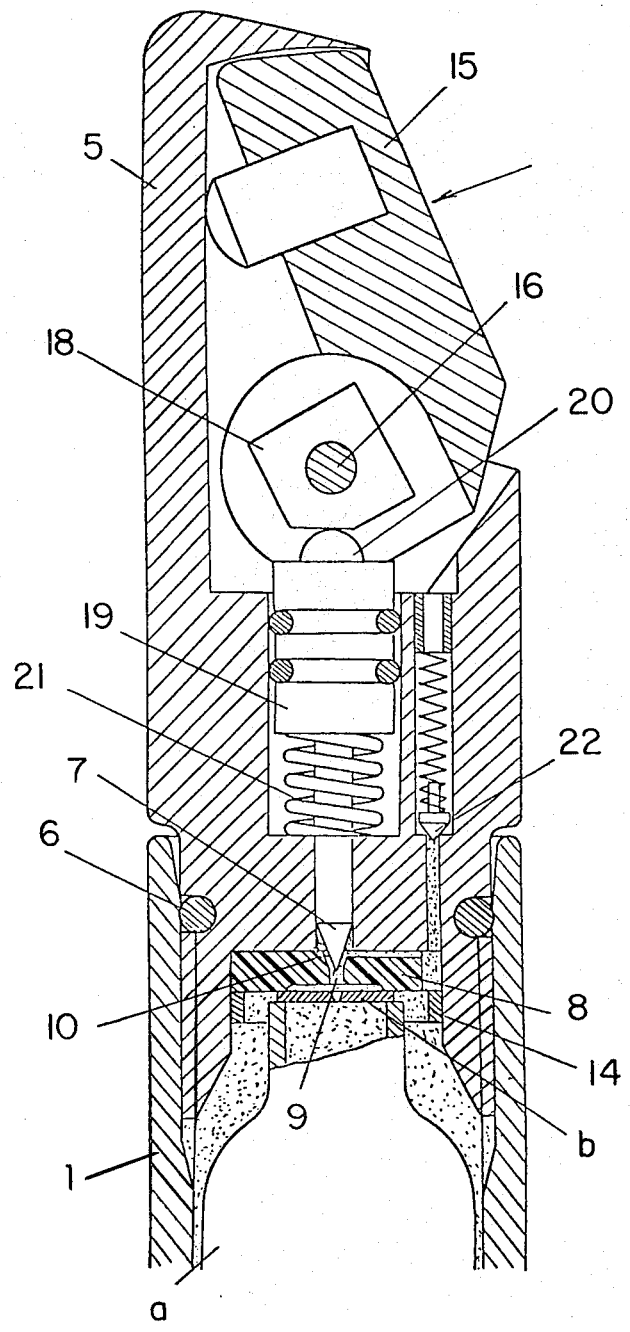
FIG. 4 is a longitudinal cross-sectional view the major portion of the device were the needle valve is opened.

The insertion needle 2 is then pushed through the cork (d) in the neck of the bottle (c) (such as of wine), and the operation handle 15 is depressed whereby the cam 18 provided at the base portion of the operation handle 15 is then rotated to first depress the valve rod 19 of the needle valve 7 whereby the needle valve 7 descends while deflecting the resilient valve seat plate 8 as shown in FIG. 3 and sticks into the cap (b) of the gas bomb (a). As the cam 18 rotates further, as shown in FIGS. 1 and 4, the valve rod 19 is pushed up by the actions of the spring 21 and the gas pressure whereby the needle valve 7 separates away from the valve seat 10 to form a small gap. Thus, the gas (e) in the gas bomb (a) is allowed to enter into the cylindrical container 1 through the gas-flow path formed by the gas supply hole 9, gas-flow groove 12 and gas-flow notch 13, and is then fed into the bottle (c) through the air passage 3 of the insertion needle 2. As the gas is fed into the air-space present below the cork when the bottle (c) is upright, the pressure rises in the bottle (c) accordingly then the cork (d) in the neck of the bottle (c) is pushed upward by the pressure and thus removed.

After the cork (d) having been removed, the operation handle 15 which had been depressed is released and allowed to return to the initial position being urged by the spring 17. Then, the cam 18 returns to the initial position, and the needle valve 7 comes to rest in contact with the valve seat 10 wherein the valve 7 is maintained in the closed state, and the flow of gas from the gas cylinder (a) is stopped as shown in FIG. 2, so that the remaining gas may be preserved for use in the next time.

Those practical advantages provided according to the present invention will be hereunder summerized:

According to the present invention as mentioned above, because of use of the resilient valve seat plate as a valve seat for the needle valve which opens and closes the gas supply hole, a closed state is ensured between the needle valve and the valve seat thereby making it possible to prevent the leakage of the gas.

Furthermore, according to the present invention, since the resilient valve seat plate is used as the valve seat for the needle valve which opens and closes the gas supply hole, the needle valve may be downwardly protruded to a sufficient degree while deflecting the resilient valve seat plate and the cap of the gas bomb may be opened by the needle valve.

Moreover, according to the present invention, since the resilient valve seat plate is used as the valve seat for the needle valve which opens and closes the gas supply hole, the lower surface of the resilient valve seat plate may be utilized as a packing for supporting the cap of the gas bomb accommodated in the cylindrical container.

What is claimed is:

1. An improved cork-extracting device comprising: a cylindrical container accommodating a gas bomb filled with gas such as carbonic acid gas, inert gas or the like and having a piercable cap for maintaining the gas within the gas bomb; an insertion needle having a longitudinal air passage communicated with the cylindrical container, the needle being located on the outside and at the bottom of the cylindrical container; a cover for said cylindrical container with a packing for air-tight sealing of said cover to said container, said cover being detachably attached to an opening portion of the cylindrical container, the cover having a needle valve that ascends and descends therein to pierce the cap of the gas bomb; said cover further having a resilient valve seat plate at a position opposed to the needle valve and above the piercable cap of the gas bomb, the resilient valve seat plate having a valve seat for said needle which valve seat has a gas supply hole at the center thereof, and lower surface of the resilient valve seat plate being utilized as packing for supporting the piercable cap of the gas bomb which is accommodated in the cylindrical container; a gas-flow path formed between the upper surface of the resilient valve seat plate and the cylindrical container, said gas-flow path formed between the upper surface of the resilient valve seat plate and the cylindrical container comprising a gas-flow groove in the upper surface of said resilient valve seat plate and a gas-flow notch formed in the peripheral portion of the valve seat plate, with said gas-flow groove and said gas-flow notch together forming said gas-flow path; an operation handle fitted to one side of the cover being supported by a rotary shaft and being urged by a spring; and an opening/closing cam provided for the operation rod to maintain the needle valve in a closed state all the time.

2. The improved cork-extracting device according to claim 1, wherein the resilient valve seat plate having a valve seat for the needle valve is made of a synthetic resin-type rubber such as urethane rubber.

3. The improved cork-extracting device according to claim 1, wherein a recessed portion is formed on the lower surface of the resilient valve seat plate in the peripheral portion of the gas supply hole to define a thinner central area surrounded by a thicker annular area so as to permit deflection of the resilient valve seat plate.

4. The improved cork-extracting device according to claim 1, wherein the cam for opening and closing the needle valve is rotated by the operation rod being depressed, the needle valve first descends then ascends to a position higher than the initial position so as to form a small gap between the valve seat and the needle valve.

5. The improved cork-extracting device according to claim 1, wherein an exhaust hole is formed in the cover to communicate the inside with the outside thereof, and a relief valve is formed in said exhaust hole to adjust the pressure in the cylindrical container.

6. The improved cork-extracting device according to claim 1, wherein the resilient valve seat plate having a valve seat for the needle valve is formed of urethane rubber, a recessed portion being formed on the lower surface of the resilient valve seat plate in the peripheral portion of the gas supply hole to permit deflection of the resilient valve seat plate.

* * * * *